US006189302B1

(12) United States Patent
Kudo et al.

(10) Patent No.: US 6,189,302 B1
(45) **Date of Patent: *Feb. 20, 2001**

(54) FILM GRIPPER AND A FILM PACKAGING MACHINE

(75) Inventors: Akira Kudo, Yokohama; Toru Nishiie, Numazu; Izumi Matsushita, Shizuoka-ken, all of (JP)

(73) Assignee: Toshiba Tec Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/038,606

(22) Filed: Mar. 11, 1998

(30) Foreign Application Priority Data

Mar. 17, 1997 (JP) ..... 9-063475

(51) Int. Cl.[7] ..... B65B 53/00; B65B 41/12
(52) U.S. Cl. ..... 53/556; 53/228; 294/902
(58) Field of Search ..... 53/556, 228, 210, 53/203, 587, 588, 461, 463; 294/902

(56) References Cited

U.S. PATENT DOCUMENTS

| | | | | |
|---|---|---|---|---|
| 3,640,051 | | 2/1972 | Cloud, Jr. . | |
| 3,864,181 | * | 2/1975 | Wolinski et al. | 53/452 X |
| 3,967,433 | | 7/1976 | Bonfiglioli . | |
| 4,102,513 | * | 7/1978 | Guard | 53/390 X |
| 4,501,106 | * | 2/1985 | Treiber et al. | 53/556 |
| 5,383,326 | * | 1/1995 | Dean et al. | 53/556 |
| 5,704,258 | * | 1/1998 | Lavoie | 53/381.4 |

FOREIGN PATENT DOCUMENTS

| | | |
|---|---|---|
| 57640/94 | 9/1994 | (AU) . |
| 59313/94 | 10/1994 | (AU) . |
| 75913/94 | 5/1995 | (AU) . |
| 0117517 A2 | 9/1984 | (EP) . |
| 0569615 A1 | 11/1993 | (EP) . |
| 2246450 | 5/1975 | (FR) . |

* cited by examiner

*Primary Examiner*—Linda Johnson
(74) *Attorney, Agent, or Firm*—Frishauf, Holtz, Goodman, Langer & Chick, P.C.

(57) ABSTRACT

Each of side grippers that function as a film gripper includes upper and lower openable clampers. These clampers are designed to hold an edge portion of a film, and are opened after film packaging is completed. At least one film contact member, out of two film contact members that are attached individually to the upper and lower clampers, is formed of a cowhide, a material having a property such that a frictional force between the contact member and the film increases to and stays at a certain level as the humidity around the film rises. With use of the film contact member made of the hide, the film gripping force can be restrained from decreasing and the film-releasability can be improved despite the increase of the humidity.

15 Claims, 13 Drawing Sheets

FILM GRIPPER AND A FILM PACKAGING MACHINE

BACKGROUND OF THE INVENTION

The present invention relates to a film packaging machine and a film packaging method for automatically packaging a to-be-packaged object, such as a flat tray containing foodstuff, by using a stretchable film or the like, and a film gripper for holding the film in the automatic packaging operation.

There are film packaging machines that can automatically package a to-be-packaged object together with a tray in a stretchable packaging film of polyvinylchloride resin. These machines are described in, for example, Australian Patents Nos. AU-A-59313/94 and AU-A-57640/94. One such film packaging machine comprises a movable front gripper and a pair of movable side grippers. The front gripper is used to seize a delivery-side end portion of the film and draw out the film toward the object to the packaged. The side grippers, which are arranged on either side of the drawn-out film with respect to the width direction thereof, serve individually to seize the opposite side edge portions of the film and extend the film width.

In the film packaging machine, the film drawn out by means of the front gripper is stretched in the width direction by means of the side grippers, and is put on a tray that contains a foodstuff therein. Thereafter, the film is tucked under the outer surface of the bottom of the tray from both sides in the delivery direction (drawing direction of the front gripper) and in the width direction, whereupon the tray is packaged.

These individual grippers constitute a so-called film gripper, and each include an upper clamper in the form of a flat iron plate or the like and an arm-shaped Flower clamper that is disposed under the upper clamper so as to move open-and-close directions relative to the upper clamper. Polyurethane sponge rubber with a closed-cell structure is put on the upper surface of the distal end portion of the lower clamper. This sponge rubber is caused to touch and leave the lower surface (film contact surface) of the distal end portion of the upper clamper when the lower clamper is moved open-and-close directions. Each gripper is moved toward a side edge portion or other part of the film with its lower clamper rotate downward so that the two clampers are open. When the lower clamper is moved upward after the side edge portion or the like is interposed between the upper and lower clampers and clamped by the clampers, the clampers are moved toward their original position. In this manner, the film is drawn out or the drawn-out film is stretched in its width direction.

During this stretching operation, the film is kept gripped without slipping off the gripper as the aforesaid rubber (polyurethane sponge rubber) is in contact with the film.

Besides the film packaging machine constructed in this manner, there is a known film packaging machine of an alternative construction. In this second type, one of a pair of side grippers that are located on either side of a film is immovable, while the other is movable, in the case of the drawn-out film is stretched in its width direction. The film is stretched in its width direction as the other side gripper moves. The grippers of this packaging machine, like the aforementioned ones, use the closed-cell polyurethane sponge rubber for their film contact members, whereby the film can be kept gripped.

The assignee hereof has recently proposed a novel film packaging machine. In this packaging machine, film contact members of a film gripper are formed of silicone rubber in place of the conventional closed-cell polyurethane sponge rubber, whereby reduction of the film gripping force can be restrained even when the machine is operated at high humidity.

Film packaging machines may possibly be used in various environmental conditions including highly humid working conditions, regions, and times, e.g., on watered floors of kitchens. In order to achieve satisfactory automatic packaging operation without regard to the working conditions, therefore, the film holding performance of each gripper must be maintained to prevent a stretched film from unexpectedly slipping off the gripper.

However, this problem cannot be solved by the conventional film packaging machines that use the closed-cell polyurethane sponge rubber for their film contact members.

If the film or grippers sweat during use at high humidity or due to changes in temperature in the working environment, therefore, water makes the film held by the grippers so slippery on the aforesaid rubber that the possibility of the film slipping off the grippers increases, thus resulting in defective packaging.

A result represented by curve A in FIG. 13 (mentioned later) was obtained from a frictional force measurement test conducted by the inventor hereof.

The following test conditions were employed. In FIG. 11 showing a tester, numeral 201 denotes a base plate; 202, a top plate mounted on the base plate 201 by means of a stud 203; and 204, film contact members fixed to the upper surface of the base plate 201 and the lower surface of the top plate 202 by means of double-side-coated adhesive tapes 205, individually. Further, numerals 206, 207 and 208 denote a weight, a film specimen (sample) 40 mm wide and 25 mm long, and a tension gage anchored to a sheet metal 209 that is bonded to one end portion of the specimen 207.

In the frictional force measurement test, the specimen 207 is interposed between the upper and lower film contact members 204, and the weight 206 of 200 grams is placed on the top plate 202. In this state, the tension gage 208 is pulled in the horizontal direction, and the resulting tensile load or frictional force is read. The frictional force is measured at 25° C. by means of the tension gage 208 with the humidity gradually increased from 40% by 10% at a time.

The result of this frictional force measurement test indicates that the gripper using the conventional closed-cell polyurethane sponge rubber for its film contact members exhibits a relatively small frictional force even at low humidity and its film gripping force or frictional force decreases as the humidity increases. As is evident from this result, the conventional polyurethane sponge rubber has good film-releasability, and actually it is known that the rubber has a good releasability.

Although there are no obvious reasons why the film gripping force decreases in the aforesaid manner, the following phenomena may possibly be the cause of this effect. A chloroethylene film, which is conventionally used for packaging, contains a cloud preventive such as a surfactant. It is supposed that the cloud preventive oozes out and adheres to the respective film contact surfaces of the film contact members of polyurethane sponge rubber, thereby changing conditions for contact with the film (or making the film slippery), while a to-be-packaged object is being packaged. Since water on the film never moves once it gets into a space between the film contact surfaces of the closed-cell polyurethane sponge rubber, a water film is inevitably formed between the film and the rubber surfaces.

Thus, as mentioned before, the film packaging machine using the conventional film gripper and the film packaging method carried out by means of this machine are subject to the problem that the gripped film becomes liable to slip off, thereby causing defective packaging, as the humidity increases. It was ascertained that a small frictional force cannot prevent the film from slipping off at the humidity of 90%, as indicated by curve A in FIG. 13.

In FIG. 13, curve G represents a result of the aforesaid frictional force measurement test conducted in the same conditions on silicone rubber for film contact members. As seen from this result, the silicone rubber film contact members have a greater low-humidity frictional force than the conventional ones that are formed of polyurethane sponge rubber. While the frictional force slightly increases at the humidity of 60% and below, it decreases as the humidity increases thereafter. Nevertheless, the silicone rubber contact members can maintain a frictional force much greater than that of the conventional polyurethane sponge rubber. Thus, a film gripper using this silicone rubber is not subject to any substantial reduction in film gripping force.

The inventor hereof ascertained, however, that the film gripper based on the silicone rubber is poor in film-releasability (or capability in separating from the gripped film). Although the cause of this drawback has not yet been cleared up, it may possibly be attributed to the following inclinations of the gripper. The surface of a silicone rubber contact member may be made apparently soft and sticky by pressure (gripping force) applied thereto during use, chemical change attributable to wear, and oozes of siloxane or other low-molecular materials that are contained in a plasticizer in the silicone rubber. Otherwise, the silicon rubber surface may be smoothed down by abrasion, so that the film can more easily adhere to the rubber, thus increasing frictional resistance.

If the film-releasability is low, as described above, left- and right-hand film grippers sometimes may be ill balanced as they release the film or may drag the film when they are opened and return to their respective original positions after the film is tucked under the outer surface of the base of a to-be-packaged object. Accordingly, lap portions of the film on the underside of the object may not be long enough, the film may be torn, or the object may be dragged together with the film, thus resulting in defective packaging.

BRIEF SUMMARY OF THE INVENTION

Accordingly, the object of the present invention is to provide a film gripper, a film packaging machine, and a film packaging method, whereby a film can be securely prevented from slipping out of grippers without lowering film-releasability even at high ambient humidity, so that automatic packaging can be accomplished.

A film gripper according to the present invention comprises openable film nipping portions. A film contact member is attached to at least one of these nipping portions. The contact member is brought into contact with a film, in which a to-be-packaged object is to be packaged, to hold an edge portion of the film. When packaging the to-be-packaged object is finished, the two film nipping portions are opened to release the film.

In order to achieve the above object, the film gripper of the invention is characterized in that at least one of these film contact members is formed of a material having a property such that a frictional force between the member and the film makes no change or increases within a certain range as the ambient humidity rises.

The film contact member may be formed of hygroscopic materials, especially leathers, non-woven fabrics, and other materials having a fibrous structure in the form of a network in which innumerous fibers are intertwined with one another, or a foam having a closed-cell or an open-cell structure. In the case where the film contact member is attached to either of the film nipping portions, these various materials may be combined for use.

In this film gripper, the film contact member attached to the film nipping portion has a property such that its film gripping force never decreases as the humidity increases. Even though the ambient humidity increases, therefore, the film gripping force can be kept at a given value or above, so that the film can be securely prevented from slipped out. Moreover, the film-releasability of the film contact member is satisfactory. Thus, despite the increase of the humidity, the film-releasability, as well as the film gripping force, can be maintained. In consequence, the automatic packaging operation can be accomplished without failure by using the film gripper of the invention.

In the film packaging machine according to the present invention, moreover, the film gripper comprises film nipping portions that are combined to be movable with respect to each other for open-close operation. A film contact member is attached to at least one of the nipping portions, and is adapted to touch a film for packaging a to-be-packaged object so as to hold an edge portion of the film. After the film is tucked under the outer surface of the base of the to-be-packaged object by moving the film gripper, the two film nipping portions are opened to release the film. In this manner, the to-be-packaged object is packaged in the film.

In order to achieve the above object, moreover, the film packaging machine according to the invention is characterized by comprising the film gripper described above.

The leathers according to the invention include a artificial leathers as well as natural leathers.

Owing to the properties of the film contact member used in the film gripper of this film packaging machine, a film gripping force of a given value or above can be maintained despite the increase of the ambient humidity, and good film-releasability can be enjoyed. During the automatic packaging operation, therefore, the film held by the film gripper can be prevented from unexpectedly slipping off the gripper or from failing to separate satisfactorily from the gripper. Thus, the automatic packaging operation can be accomplished without defectiveness.

In a film packaging method according to the invention, in order to achieve the above object, a delivery-side edge portion of a stretchable packaging film is first held by means of an openable front gripper, and the film is drawn out onto a to-be-packaged object by means of the front gripper. Then, the drawn-out film is stretched in its width direction with its side edge portions held by means of a pair of side grippers that are movable in the width direction of the film. Thereafter, the side edge portions of the stretched film are lapped on the outer surface of the base of the to-be-packaged object by moving the side grippers along the underside of the object from both sides thereof. Then, the side grippers are opened to release the film. Thus, the to-be-packaged object can be automatically packaged in a manner such that the upper surface, both sides and the bottom surface of the object is covered entirely by the stretched film.

Owing to the properties of film contact members used in the grippers of this film packaging method, a film gripping force of a given value or above can be maintained despite the increase of the ambient humidity, and good film-releasability can be enjoyed. Therefore, the film held by the grippers can be prevented from unexpectedly slipping off the grippers when it is stretched during the packaging operation or when the stretched film is tucked under the base of the to-be-packaged object. Further, the tucked film can be released from the grippers without separation failure. Thus, the packaging operation can be accomplished without any defectiveness.

According to the film gripper, film packaging machine, and film packaging method described above, the film gripping force is never reduced despite the increase of the humidity, and the film-releasability is satisfactory. Even at high ambient humidity, therefore, the film can be prevented from unexpectedly slipping off the gripper or grippers and the film-releasability is satisfactory. Thus, the automatic packaging operation can be accomplished without defectiveness.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments give below, serve to explain the principles of the invention.

DETAILED DESCRIPTION OF THE INVENTION

A first embodiment of the present invention will now be described in detail with reference to the accompanying drawings of FIGS. 1 to 11.

Figure 1:
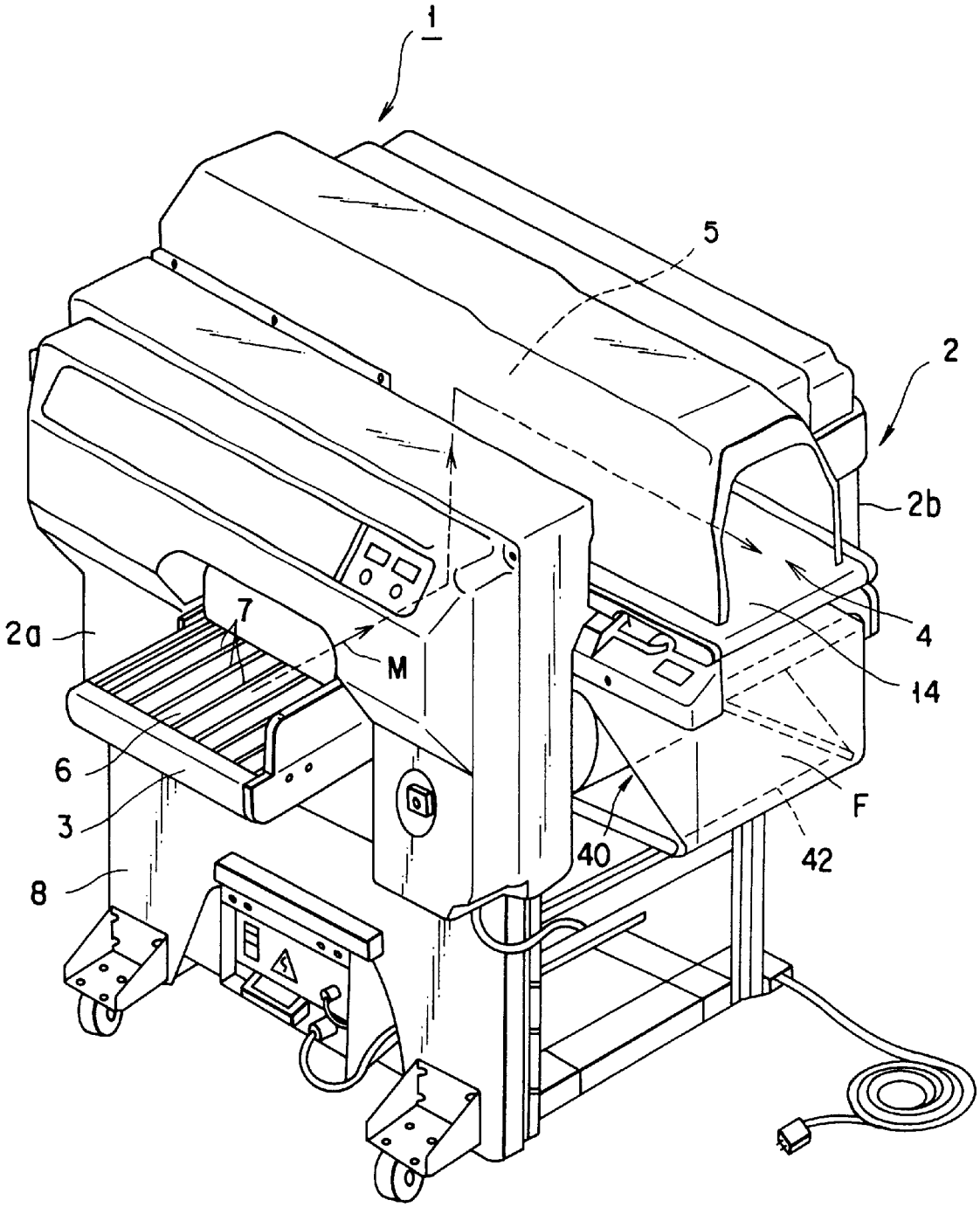
FIG. 1 is a perspective view showing a general arrangement of a film packaging machine according to a first embodiment of the present invention.

FIG. 1 shows a general arrangement of a film packaging machine 1. The machine 1 comprises a frame 2 that includes a front panel 2*a* (see FIG. 1) and a rear panel 2*b* (see FIG. 3). The frame 2 is provided with a tray loading section 3, tray unloading section 4, tray packaging section 5, and film supply section 40. In FIG. 1, arrow M indicates a path of transfer for a to-be-packaged object (tray or the like), and numeral 8 denotes a stand on which the packaging machine 1 is placed.

The tray loading section 3 is provided with a horizontal belt conveyor 6 that penetrates the front panel 2*a* in the front-and-rear direction of the packaging machine 1. The rear portion of the conveyor 6 is located between the two panels 2*a* and 2*b*. The conveyor 6 includes a plurality of endless belts 7 that are spaced in its width direction. A tray 10 (see FIG. 2 and other drawings) in the form of an open-topped flat square box is fed onto the upper surface of the front portion of the conveyor 6. The tray 10 contains foodstuff or the like as the to-be-packaged object.

Figure 3:
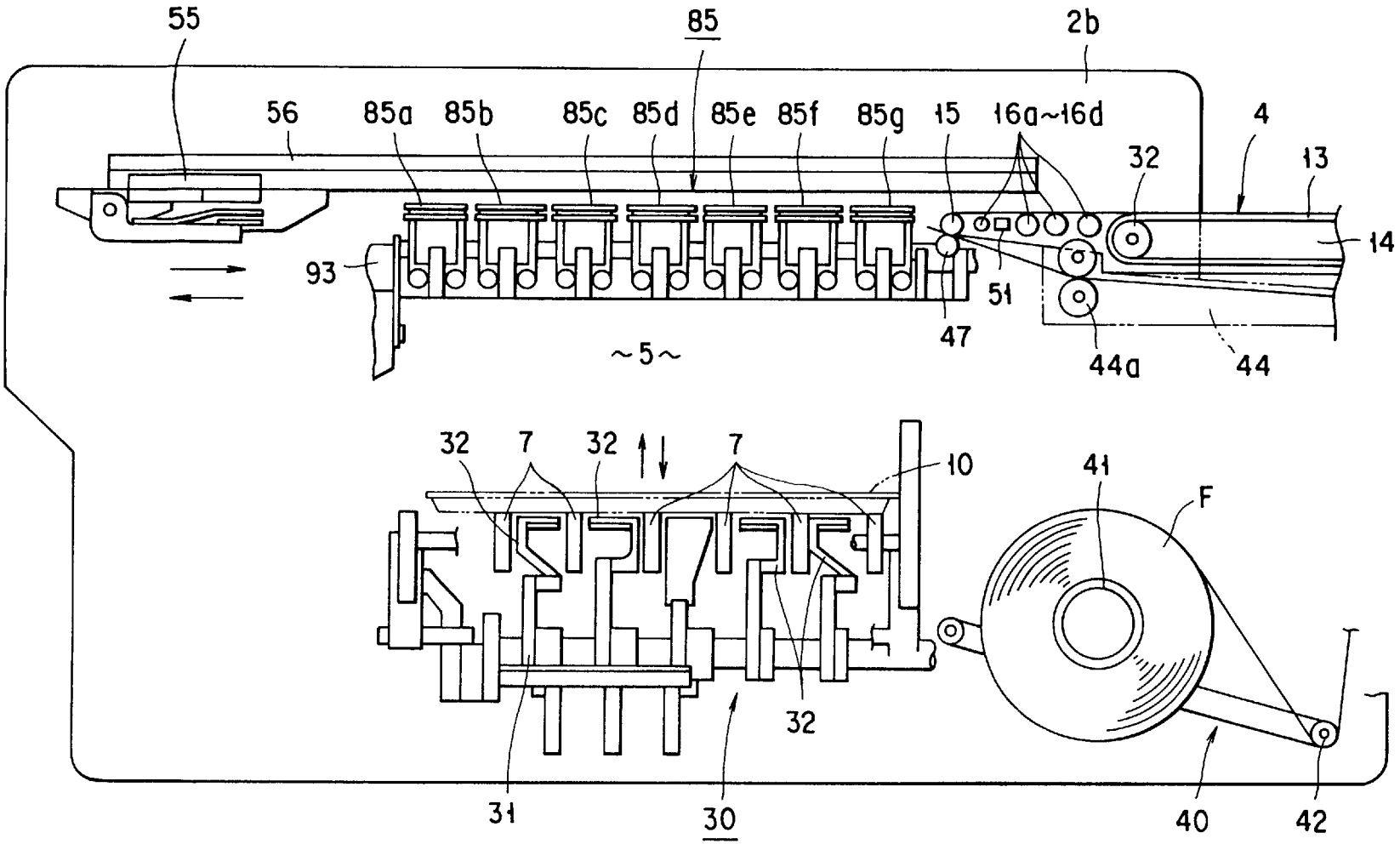
FIG. 3 is a sectional view showing an arrangement of the tray packaging section of the packaging machine.
Figure 4:
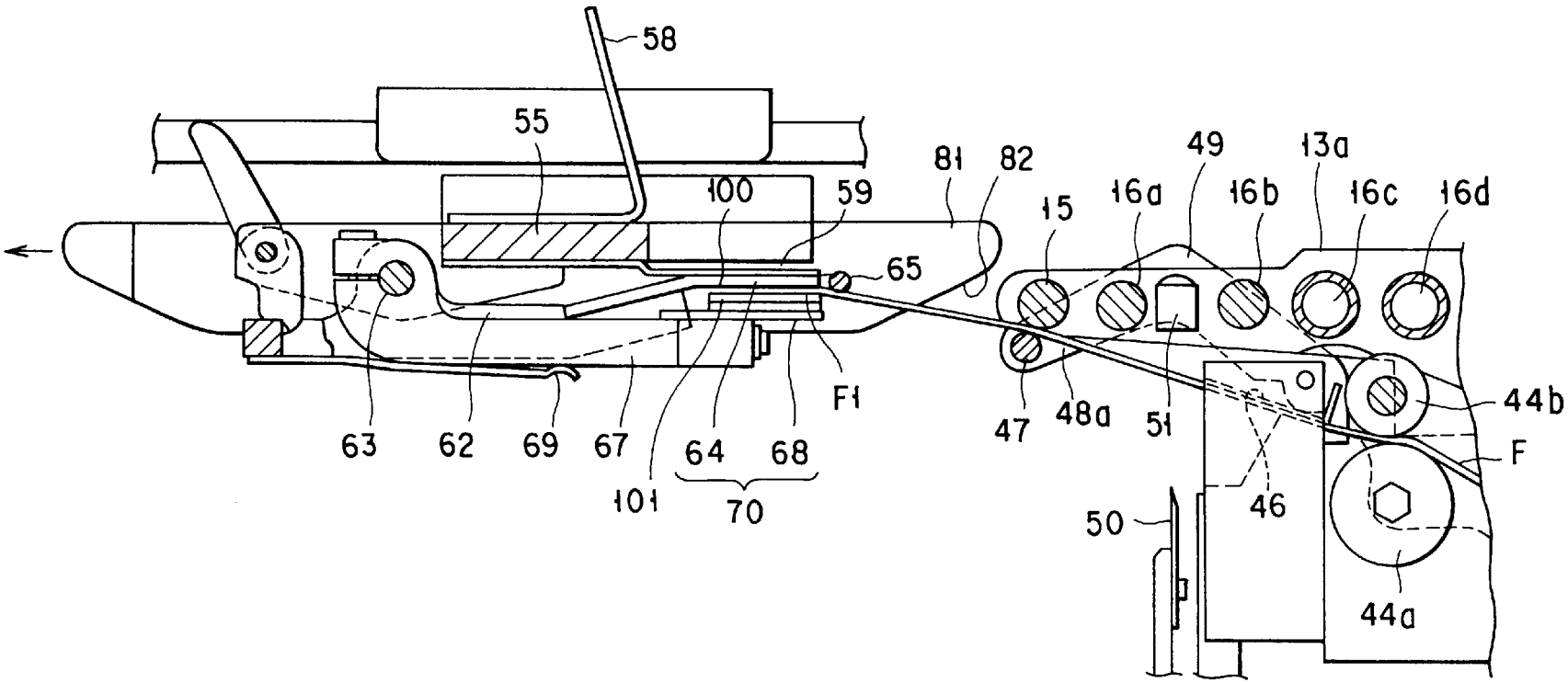
FIG. 4 is a sectional view showing the way a front gripper of the packaging machine seizes and draws out a film.

Between the panels 2*a* and 2*b*, the tray unloading section 4 is situated in a higher position than the tray loading section 3. As shown in FIGS. 3 and 4, the unloading section 4 is provided with a horizontal endless unloading belt conveyor 13 and an electric heater 14 inside the conveyor 13. Further, a turn-down roller 15 is provided on the loading side of the conveyor 13, and a plurality of unloading rollers 16*a*, 16*b*, 16*c* and 16*d* and a cutter receiver 51 are arranged in parallel relation between the roller 15 and the conveyor 13. The rollers 15 and 16*a* to 16*d* and the belt conveyor 13 are synchronously rotated in the same direction by means of a drive mechanism (not shown). The heater 14 has a function to weld a film F (mentioned later) to the underside of the tray 10 after packaging.

The tray unloading section 4 is located so as to be continuous with the tray loading section 3 at right angles thereto with the tray packaging section 5 between them when the film packaging machine 1 is viewed two-dimensionally. Thus, the direction in which the to-be-packaged object is loaded into the packaging section 5 is perpendicular to the direction in which the object is unloaded from the section 5. The packaging section 5 is provided with a lifter 30 (see FIGS. 2, 3 and 5) for lifting the tray 10 that is fed into the rear part of the tray loading section 3. The lifter 30 includes a bracket 31, a plurality of support pieces 32, and an up-and-down mechanism 33 for raising and lowering the lifter 30. The support pieces 32, which are supported by the bracket 31, can pass between the endless belts 7 of the belt conveyor 6. Among the support pieces 32, the other ones than the following fixed support pieces 34 that are situated in the center with respect to the width direction of the tray loading section 3 are supported for rotation in the longitudinal direction of the loading section 3. Normally, these support pieces 32 are kept upright by means of the urging force of springs (not shown). The fixed support pieces 34 protrude from the bracket 31 so as to be located in the center of the group of support pieces 32.

The up-and-down mechanism 33 serves to move the bracket 31 vertically between a down position and an up position. In the down position, the support pieces 32 are situated below the respective upper surfaces of the endless belts 7 and face the underside of the tray 10 on the belts 7. In the up position, the tray 10 is at the same height as the tray unloading section 4.

The film supply section 40 is located under the tray unloading section 4. As shown in FIGS. 3 and 4, the supply section 40 includes a reel 41 wound with a transparent, stretchable, flexible film F, a tension roller 42 for guiding the film F drawn out of the reel 41, guide rollers 44*a* and 44*b* for guiding the film F delivered by means of the roller 42, and a dispenser 46 (shown in FIG. 4). The dispenser 46 is a comb-shaped structure wider than the film F. The guide rollers 44*a* and 44*b* and the dispenser 46 are supported on the frame 2. The film F is formed of polyvinylchloride resin or polyolefin that may or may not contain a cloud preventive. In the case where the film F is 210 mm wide, for example, it is formed of a sheet of the aforesaid synthetic resin that can be stretched substantially two- or threefold in the width direction. In the case where the film F has a width of 280 mm, for example, it is advisable to use a sheet of the aforesaid synthetic resin that can be stretched substantially 1.5 or two times in the width direction. The direction in which the film F is stretched is a direction perpendicular to the direction in which the film F is delivered from the reel 41, that is, the width direction of the film F.

Further, the film supply section 40 is provided with a grip roller 47 (see FIG. 4) that can touch and leave the underside of the turn-down roller 15. A pair of levers 48*a* (only one of which is shown) that individually support the opposite ends of the roller 47 are rotatably mounted on the frame 2. The levers 48*a* are urged upward by means of springs (not shown), whereby the roller 47 is held in a position where it is in contact with the turn-down roller 15. Each lever 48*a* has a bent portion 49 in the middle. The bent portion 49 is designed to project above a roller support frame 13*a* of the tray unloading section 4 as the grip roller 47 is rotated to the position where the grip roller 47 is in contact with the turn-down roller 15.

In FIG. 4, numeral 50 denotes a vertically movable cutter that is located under a cutter receiver 51. The cutter 50 can be moved up and down between a film cutting position and a standby position by means of a cutter drive mechanism, such as an electromagnetic solenoid (not shown). In the film cutting position, the cutter 50 projects above the dispenser 46 so that its distal end is inserted in the cutter receiver 51. In the standby position, the cutter 50 is recessed below the dispenser 46. As the cutter 50 is operated in this manner, the film F drawn out of the reel 41 is cut.

In the tray packaging section 5 between the front and rear panels 2*a* and 2*b*, as shown in FIGS. 1 and 3, a slider 55 is horizontally stretched overlying its lifter 30. The opposite end portions of the slider 55 are supported individually by guide rails 56 (only one of which is shown in FIG. 3) as guide means on the panels 2*a* and 2*b* so as to be slidable toward and away from the tray unloading section 4. The slider 55 is reciprocated between a first position in which it adjoins the unloading section 4 and a second position in which it is distant from the unloading section 4 by means of a drive unit (not shown) that includes a motor.

As shown in FIG. 4, the slider 55 is provided with a pressure plate 58 for pushing the tray 10 in the up position into the tray unloading section 4. The slider 55 is further provided with a turn-down plate 59, which is located so as to be able to get under the tray 10 to be in contact with its underside when the slider 55 is moved to the aforesaid first position.

A fork 62 is rotatably supported on the slider 55 by means of a pivot 63. An upper clamper 64 on the stationary side protrudes from the fork 62 toward the tray unloading section 4. The clamper 64 is situated right under the turn-down plate 59 and never moves in the vertical direction. A roller 65 is supported on the distal end portion of the clamper 64. An arm 67 is fixed to the pivot 63, and a comb-shaped lower clamper 68 is attached to the upper clamper 64 so as to face it from below. The lower clamper 68 is a member on the movable side capable of rocking in the vertical direction, and is urged upward by a leaf spring 69. A front gripper 70 for a delivery-side end portion F1 of the film F to be drawn out is formed including these clampers 64 and 68. The gripper 70 constitutes a part of film gripper means.

A lever pressure member 81 having a cam face 82 is provided on each end portion of the slider 55. When the slider 55 is slid to the aforesaid first position, the cam face 82 of each pressure member 81 comes into contact with the bent portion 49 of its corresponding lever 48*a*, thereby causing the lever 48*a* to rotate downward against the urging force of the corresponding spring (not shown). Thereupon, the grip roller 47 is separated downward from the turn-down roller 15.

The front gripper 70 is designed so that it engages a first cam (not shown) supported on the frame 2 when the slider 55 approaches the aforesaid first position (on the right-hand side in FIG. 4). As this is done, the cam causes the lower clamper 68 to separate from the upper clamper 64, thus effecting clamper opening operation. When the slider 55 reaches the first position, the lower and upper clampers 68 and 64 of the front gripper 70 are joined together, whereupon the delivery-side end portion F1 of the film F is seized by the front gripper 70.

Figure 2:
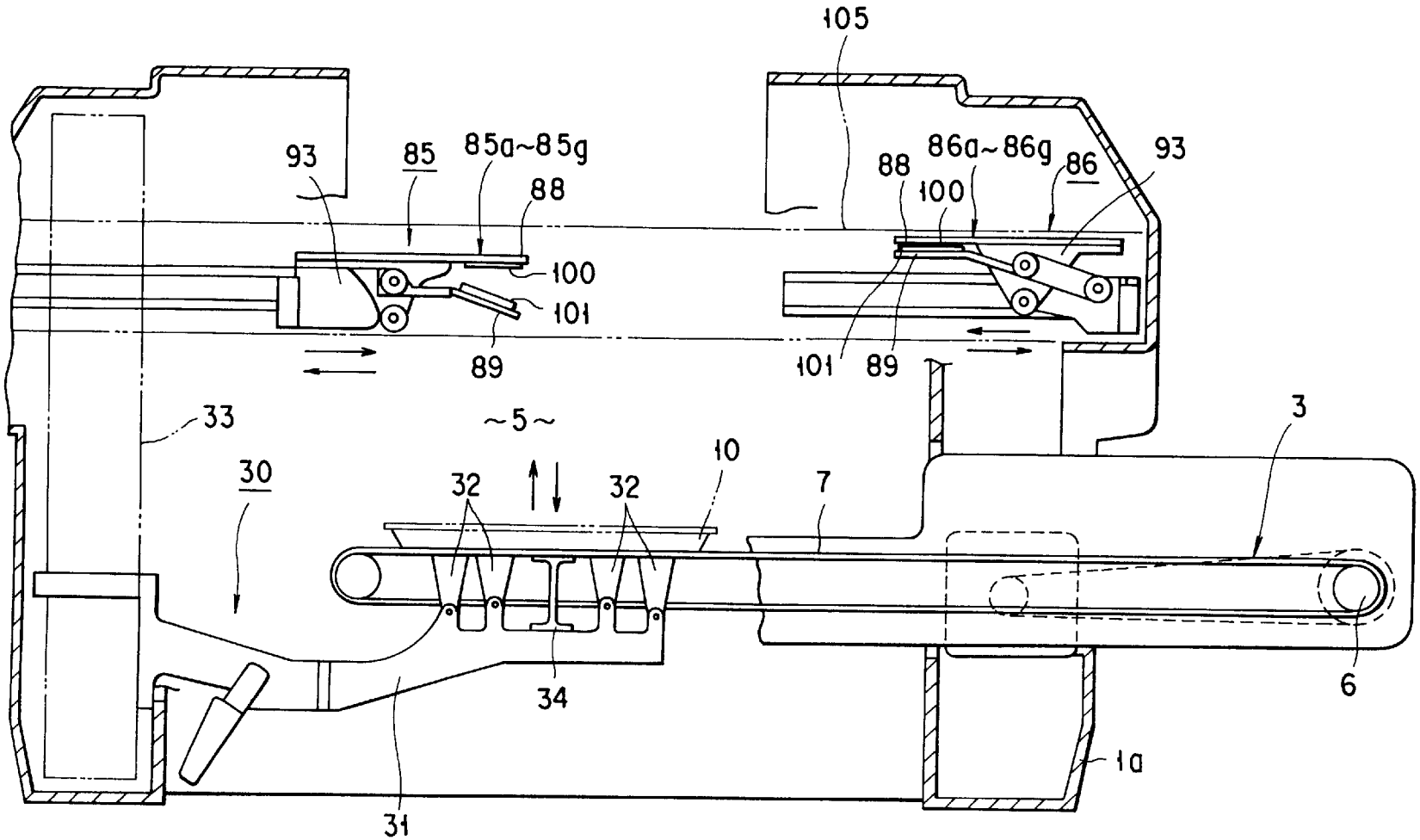
FIG. 2 is a sectional view showing an arrangement of a tray loading section and a tray packaging section of the packaging machine.
Figure 5:
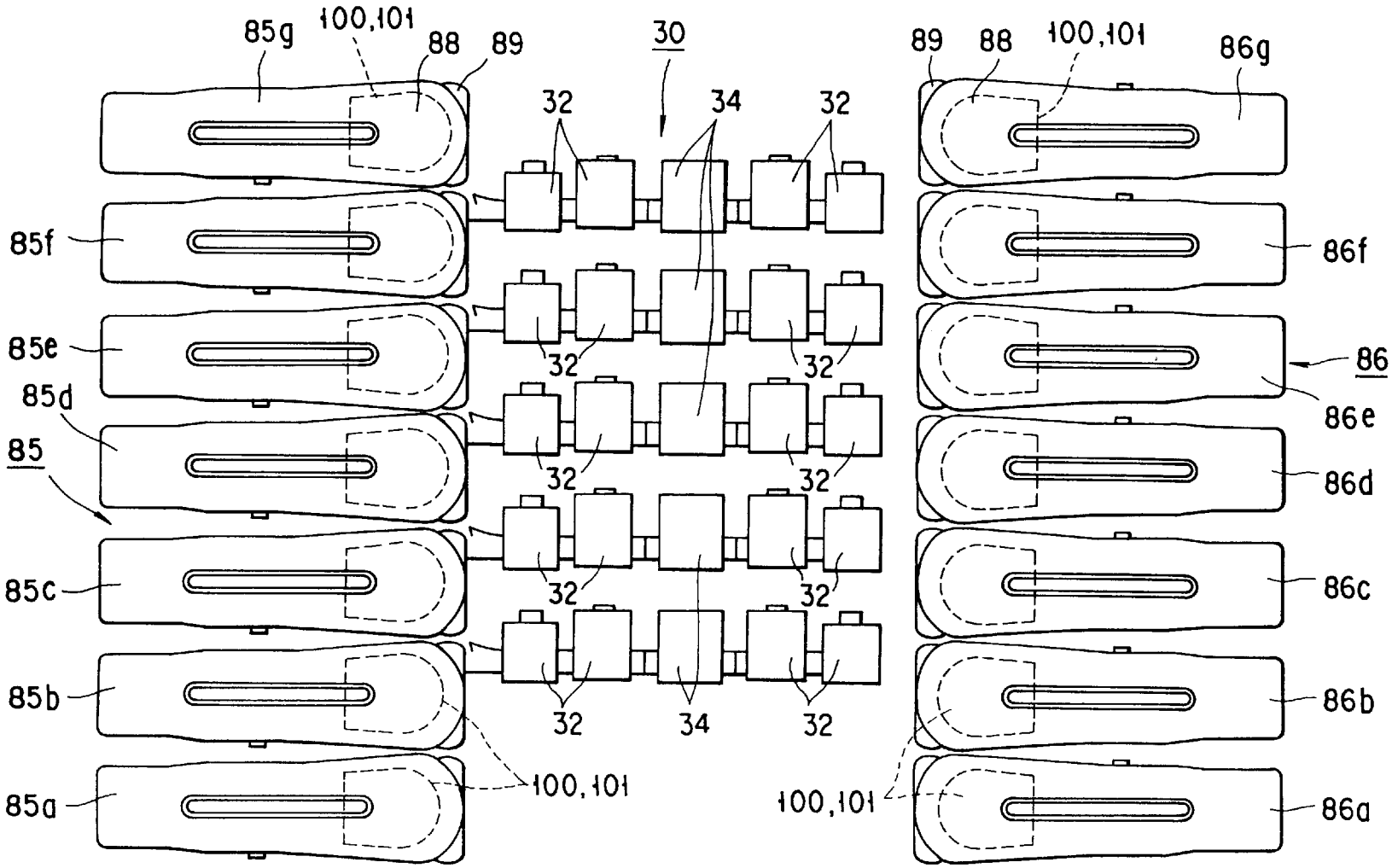
FIG. 5 is a plan view showing an arrangement of the tray packaging section of the packaging machine.

Arranged in the tray packaging section 5, as shown in FIGS. 2, 3 and 5, are a pair of side grippers 85 and 86 that constitute the film gripper means. The grippers 85 and 86 serve to seize opposite side edge portions F2 and F3, respectively, of the film F delivered to the tray packaging section 5. These grippers are located close to their corresponding side edge portions of the film F, and are supported to be movable toward and away from the frame 2 and each other.

The grippers 85 and 86 can be moved synchronously in opposite directions by means of a gripper drive mechanism 105 (shown in FIG. 2) that includes a motor (not shown). The drive mechanism 105 may, for example, be formed by combining feed screws (not shown), guide rods (not shown), and carriages 93 that are in engagement with the feed screws and movably fitted on the guide rods, individually. As the feed screws rotate, the carriages 93 reciprocate straight guided by their corresponding guide rods. The side grippers 85 and 86 are supported individually on the carriages 93 shown in FIG. 2.

Figure 6:
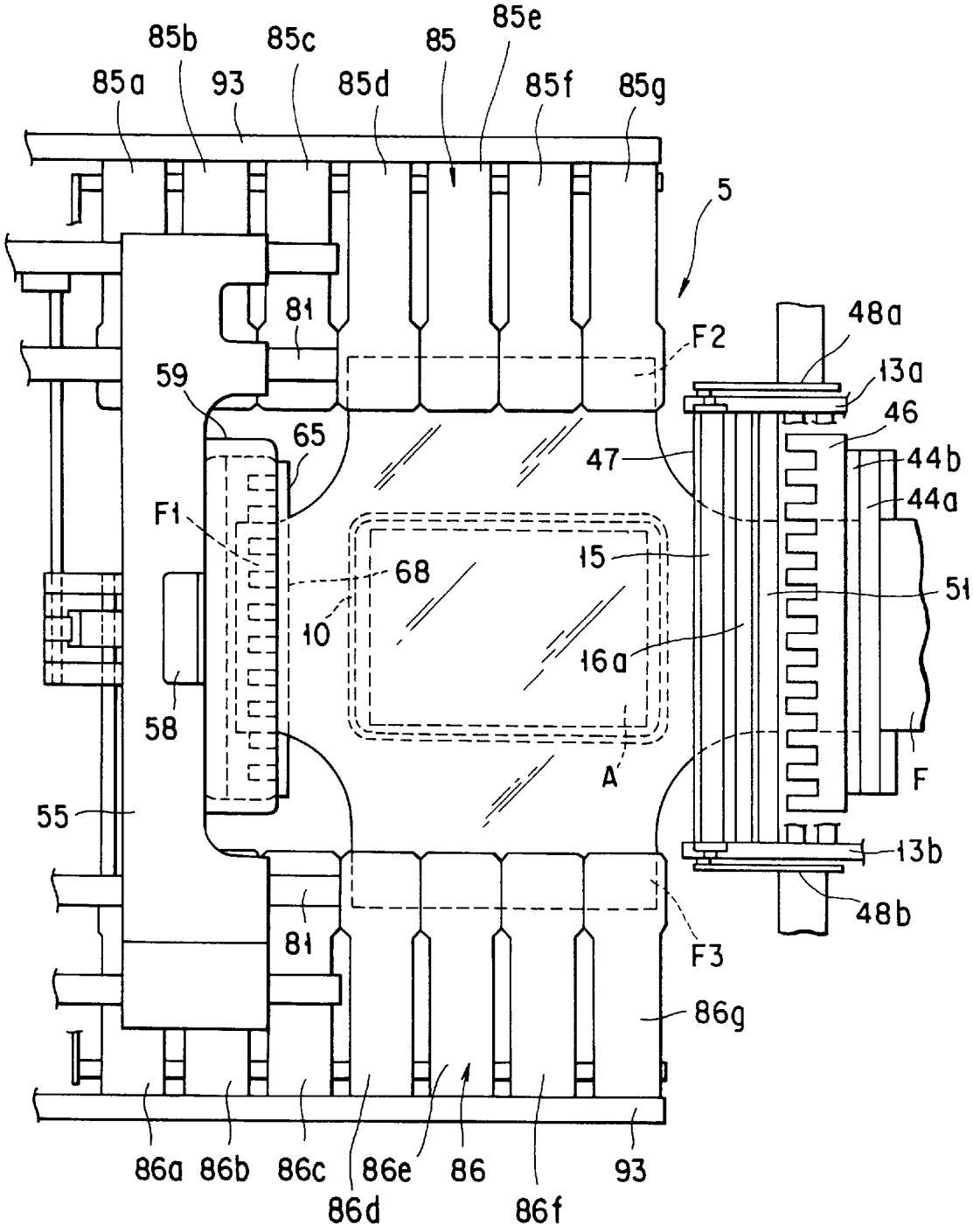
FIG. 6 is a plan view showing the tray packaging section of the packaging machine with a loaded tray pressed against the film.
Figure 7A:
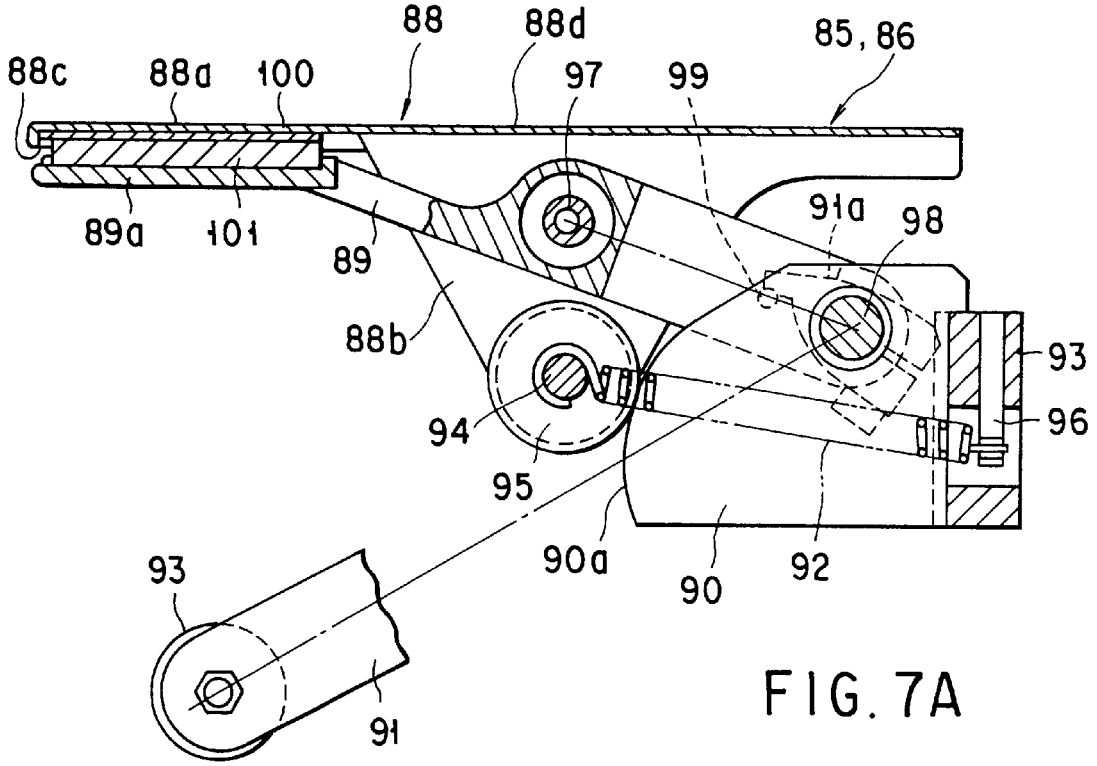
FIG. 7A is a sectional view showing a closed state of a side gripper of the packaging machine.
Figure 7B:
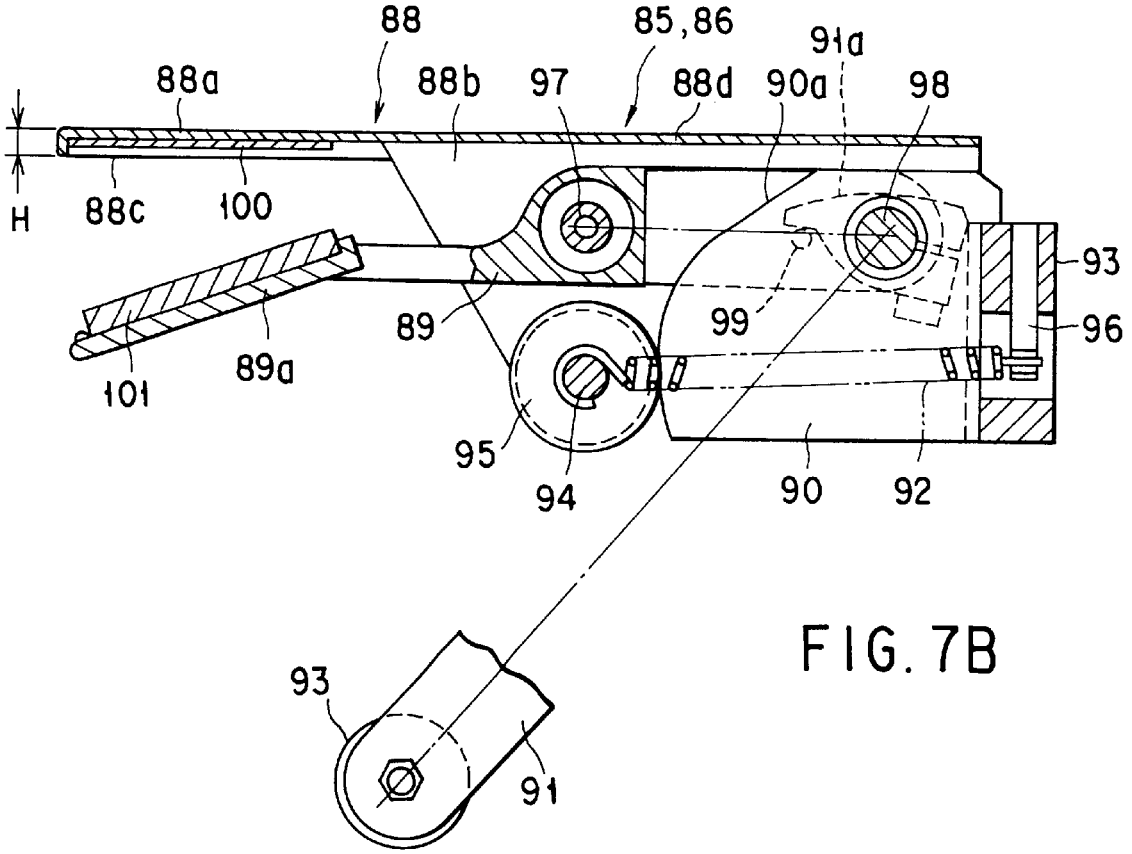
FIG. 7B is a sectional view showing an open state of the side gripper.

As shown in FIGS. 2 and 6, each side gripper 85 or 86 is an aggregate of a plurality of gripper portions, e.g., first to seventh gripper portions 85*a* to 85*g* or 86*a* to 86*g*, arranged in parallel with one another. As shown in FIGS. 7A and 7B, each gripper portion includes an upper clamper 88 on the stationary side that is immovable in the vertical direction, lower clamper 89 on the movable side that is rockable in the vertical direction, cam 90, lever 91, coil spring 92, etc. The upper and lower clampers 88 and 89 constitute a pair of film nipping portions, upper and lower, respectively.

The cam 90 protrudes from its corresponding carriage 93. The upper clamper 88 includes a pair of projections 88*b* (only one of which is shown) and a roller 95 that serves as a cam follower. Each projection 88*b* is formed by downwardly bending each side edge of the central portion of a horizontal clamper base 88*d*. The roller 95 is mounted on a shaft 94 that are stretched between the respective distal ends of the projections 88*b*. The upper clamper 88 has its roller 95 in rolling contact with a cam face 90*a* of the cam 90, and is combined with the cam 90 by means of the coil spring 92 that is stretched between the shaft 94 and a spring peg 96 on the carriage 93. The clamper base 88*d* can always be kept horizontal by means of the urging force of the spring 92.

The lower clamper 89 is rotatably supported on the pair of projections 88*b* under the clamper base 88*d* by means of a shaft 97 so that it can pass between the projections. The clamper 89 is designed so that its end portion 89*a* on the side remoter from the cam 90 can touch and leave a distal end portion 88*a* of the upper clamper 88.

The lever 91 is rotatably supported on a pivot 98 that protrudes from a side face of the cam 90. The lever 91, which is used to open and close the lower clamper 89 with reference to the upper clamper 88, includes a finger 91*a* that can engage a pin 99 on the other end portion of the lower clamper 89.

Since the respective upper clampers 88 of the gripper portions 85*a* to 85*g* and 86*a* to 86*g* are subjected to an upward force by their corresponding coil springs 92, the upper and lower clampers 88 and 89 are kept closed when lower end portion of the lever 91 is in its up position, as shown in FIG. 7A. When the lower end portion of the lever 91 in this state is rotated to its down position, as shown in FIG. 7B, the whole lower clamper 89 rotates in the counterclockwise direction of FIG. 7B around the shaft 97 with the finger 91*a* in engagement with the pin 99. As this is done, the upper clamper 88 is pressed down against the tensile force of the coil spring 92. Since the downward displacement of the lower clamper 89 by its rotating motion is greater than the descent of the upper clamper 88, in this case, the upper and lower clampers 88 and 89 are kept open, as shown in FIG. 7B. When the lever 91 is returned upward from this open state, the upper clamper 88 is raised by the tensile force of the coil spring 92, and the lower clamper 89 is rotated in the clockwise direction of FIG. 7A around the shaft 97. Thereupon, the clampers 88 and 89 are closed.

Referring now to FIGS. 8A to 8H and FIGS. 9A to 9F, there will be described processes for packaging the tray 10, containing foodstuff therein, with the film F by means of the film packaging machine 1 constructed in this manner.

Figure 8A:
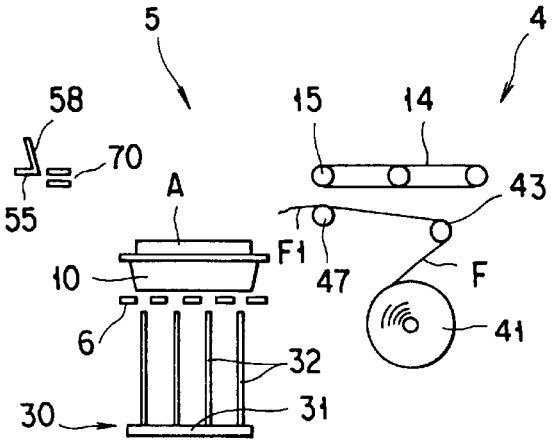
FIGS. 8A, 8B, 8C, 8D, 8E, 8F, 8G and 8H are schematic views individually showing processes for turning down the delivered film toward the underside of the tray from opposite sides in the delivery direction in the packaging machine.
Figure 8B:
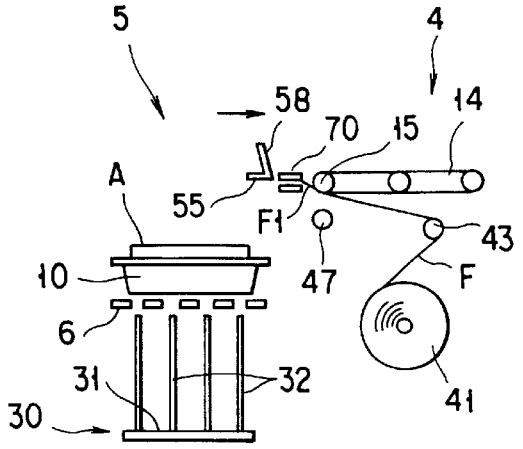

Since the tray 10, containing foodstuff A therein, is fed into the tray loading section 3 (shown in FIG. 1) with the support pieces 32 of the lifter 30 in their down position, it is supplied to the tray packaging section 5 by means of the belt conveyor 6, as shown in FIG. 8A. Thereupon, the slider 55 is moved toward the first position, as shown in FIG. 8B.

As this is done, the grip roller 47 is first downwardly separated wide from the turn-down roller 15. Then, the front gripper 70 is situated under that end portion of the tray unloading section 4 on the side of the tray packaging section 5, and the upper and lower clampers 64 and 68 of the gripper 70 are separated from each other and face the dispenser 46 (shown in FIG. 4). When the slider 55 reaches the first position shown in FIG. 8B, the lower clamper 68 is rotated upward. Thereupon, the lower and upper clampers 68 and 64 vertically hold the delivery-side edge portion F1 of the film F delivered from the dispenser 46.

Figure 8C:
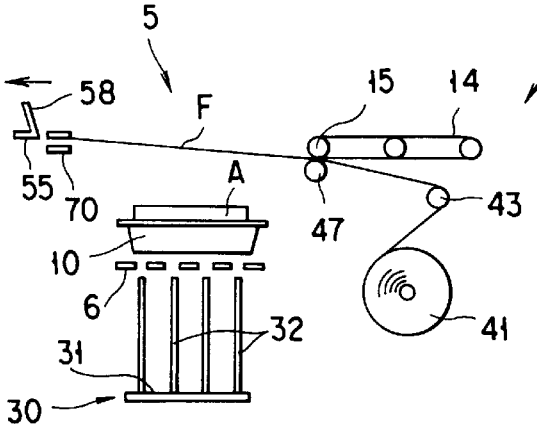

Subsequently, the slider 55 is slid to the second position corresponding to the size of the tray 10, as shown in FIG. 8C. Thereupon, the grip roller 47 moves upward so that the film F is held between the roller 47 and the turn-down roller 15. Accordingly, the film F is stretched between the rollers 15 and 47 and the front gripper 70 and drawn out onto the tray packaging section 5 to be set thereon under a suitable tension. While the film F is being drawn out in this manner, the side grippers 85 and 86 are kept off the crosswise side edge portions F2 and F3 of the film F, as shown in FIG. 9A.

Figure 9A:
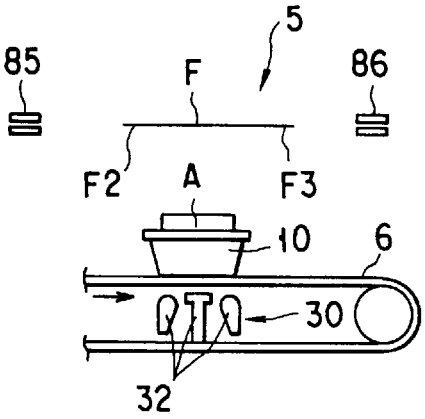
FIGS. 9A, 9B, 9C, 9D, 9E and 9F are schematic views individually showing processes for turning down the delivered film toward the underside of the tray from opposite sides in the width direction thereof in the packaging machine.
Figure 9B:
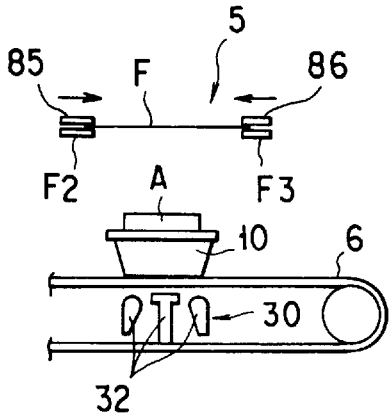

As shown in FIGS. 7B and 9A, thereafter, the upper and lower clampers 88 and 89 (shown in FIG. 2) of the side grippers 85 and 86 are first opened as their corresponding levers 91 rotate downward. Then, in this state, the side grippers 85 and 86 are advanced toward one another, and the upper and lower clampers 88 and 89 are closed as the levers 91 rotate upward (shown in FIG. 7) in the advanced position. In consequence, the side edge portions F2 and F3 of the drawn-out film F are gripped independently of each other.

Figure 9C:
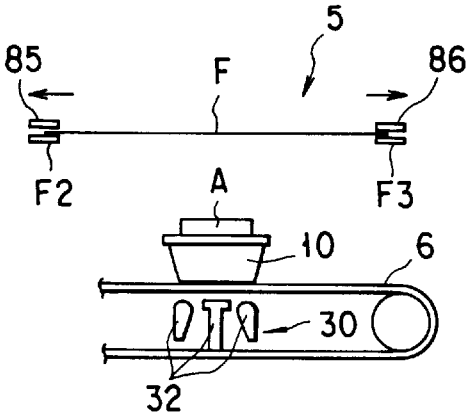

Then, the side grippers 85 and 86 are moved away from each other, depending on the width of the tray 10, as shown in FIG. 9C. As this is done, both side edge portions of the drawn-out film F are pulled, so that the film F can be stretched to a size large enough to cover the tray 10 from above.

Figure 8D:
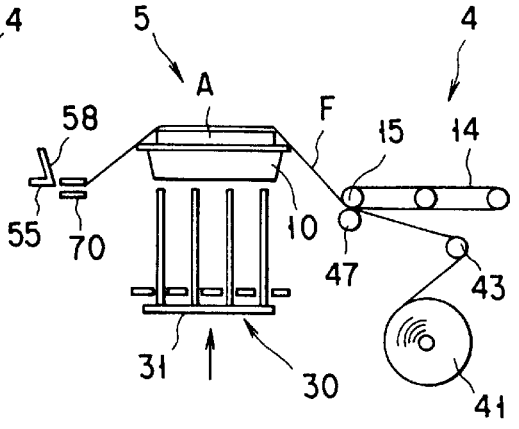
Figure 8E:
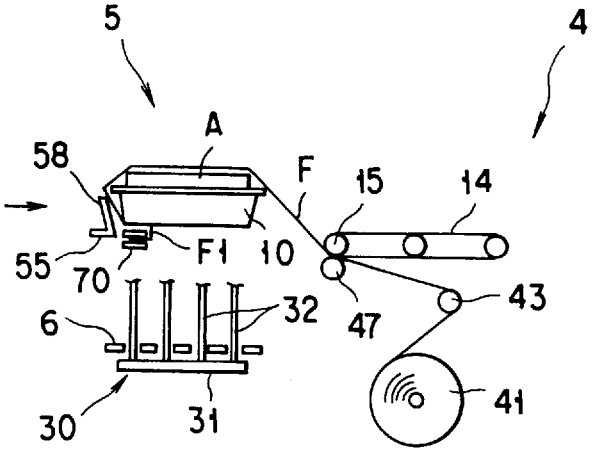
Figure 9D:
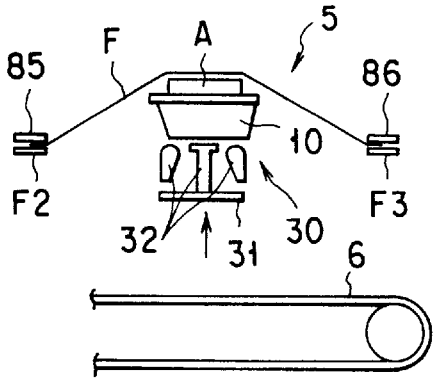

Thereafter, the tray 10 is raised by means of the lifter 30, as shown in FIGS. 8D and 9D, and this tray 10 and the foodstuff (foodstuff A) therein are pressed against the stretched film F so that the film F covers the tray 10.

Figure 9E:
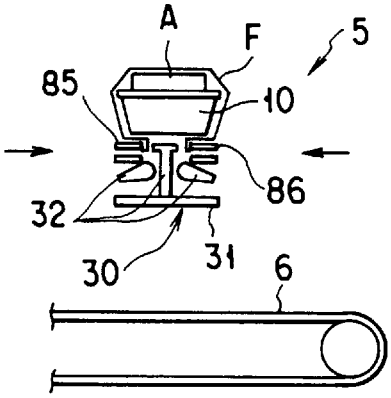
Figure 9F:
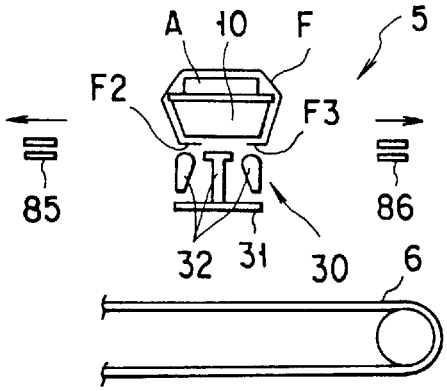

When raising the tray 10 is completed, the side grippers 85 and 86 are advanced toward each other, thereby getting under the tray 10, as shown in FIG. 9E, and the side edge portions F2 and F3 of the film F are turned down along the outer surface of the base of the tray 10. Thereafter, the respective upper and lower clampers 88 and 89 of the grippers 85 and 86 are opened and disengaged from the side edge portions F2 and F3 of the film F, and the grippers 85 and 86 are moved away from each other, whereupon the initial state shown in FIG. 9F is restored. As a result of these processes of operation, both side edge portions of the film F drawn in the tray packaging section 5 are tucked under the base of the tray 10.

Figure 8F:
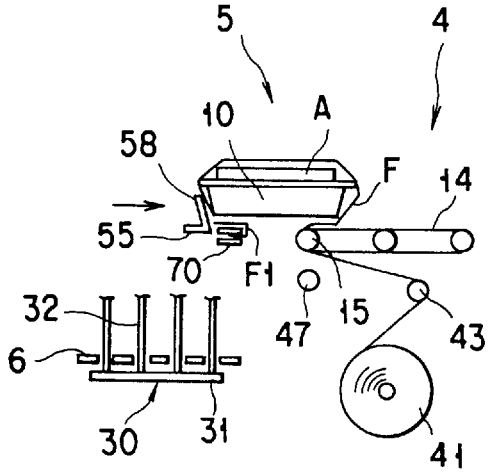

Since the slider 55 is then slid toward the first position, as shown in FIG. 8F, the turn-down plate 59 (shown in FIG. 4) gets under the base of the tray 10. Thereupon, the delivery-side end portion (front end portion) F1 of the film F seized by the front gripper 70 is turned down along the outer surface of the base of the tray 10 by the turn-down plate 59.

Figure 8G:
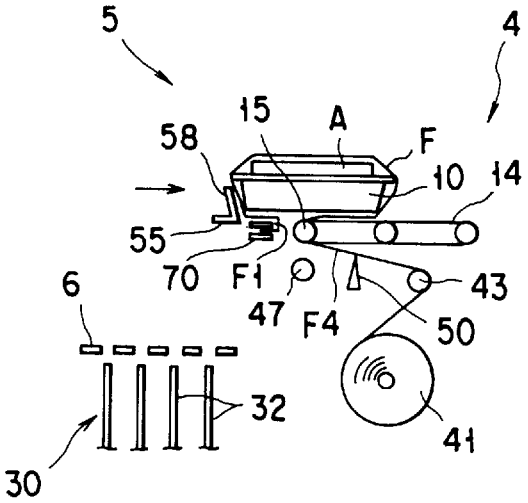

As the slider 55 further slides forward, the tray 10 is fed toward the tray unloading section 4 by means of the pressure plate 58, as is shown in FIG. 8G. In this case, the gripper portions 85*a* to 85*g* and 86*a* to 86*g* of the side grippers 85 and 86 are successively opened, the first ones 85*a* and 86*a* (remotest from the unloading section 4) first and the seventh ones 85*g* and 86*g* (nearest to the unloading section 4) last, by means of a common cam mechanism (not shown), whereupon the film F is released. The cam mechanism acts in association with the movement of the slider 55 toward the tray unloading section 4.

During these successive releasing operations of the grippers, those gripper portions which are situated nearer to the tray unloading section 4 than the ones that are about to release the film F continue to hold the gripped film F. Accordingly, the gripper portions that are on the point of releasing the film F can be more smoothly separated from a film contact member 101 (mentioned later) than in the case of an arrangement in which all gripper portions are designed to release a film simultaneously. The number of gripper portions used is settled depending on the size of the tray 10. The use of the fifth to seventh gripper portions 85*e* to 85*g* and 86*e* to 86*g* is necessary at the least. The largest available trays require use of all the gripper portions 85*a* to 85*g* and 86*a* to 86*g*.

As the tray 10 is delivered into the tray unloading section 4, it runs on the turn-down roller 15 and the unloading rollers 16*a* to 16*d*, as shown in FIGS. 8F and 8G. Thereupon, the delivery direction of the drawn film F being delivered is reversed so that the film winds around the roller 15. Then, the film F is turned down to be guided between the underside of the tray 10 and the turn-down roller 15 and the unloading rollers 16*a* to 16*d*.

Figure 8H:
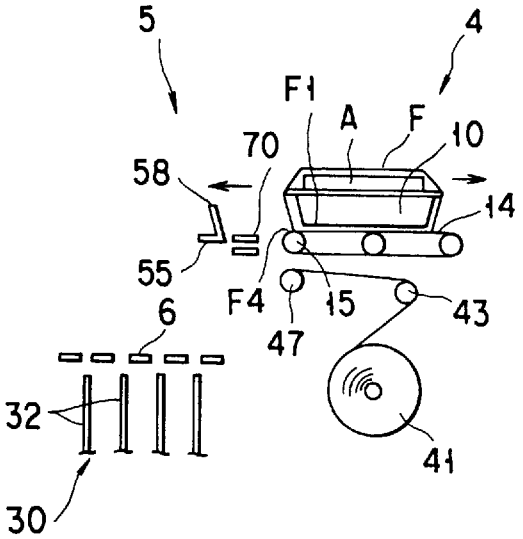

Subsequently, the cutter 50 is raised to cut the film F, as shown in FIG. 8G. A cut end portion F4 of the film F is guided to the underside of the tray 10 via the peripheral surface of the turn-down roller 15, as shown in FIG. 8H. Thus, a series of tray packaging processes using the film F is completed.

The packaged tray 10 is delivered to the unloading conveyor 13 by means of the turn-down roller 15 and the unloading rollers 16*a* to 16*d* that are rotating, whereupon it is heated from below by the heater 14. In consequence, the end portions F1 and F4 and the side edge portions F2 and F3 of the film F that overlap one another on the underside of the tray 10 are caused to adhere to one another, whereby the film F is prevented from separating from the tray 10.

In the film packaging machine 1 that repeatedly carries out the series of packaging processes in the manner described above, film contact members 100 and 101 are attached individually to those respective surfaces of the front gripper 70 and the side grippers 85 and 86 which touch the film F.

More specifically, in the front gripper 70 shown in FIG. 4, the film contact member 100, e.g., about 1 mm thick, is fixed to distal side of the lower surface of the upper clamper 64 by bonding, while the film contact member 101, e.g., about 4 mm thick, is fixed to the distal side of the comb-shaped upper surface of the lower clamper 68. Since the front gripper 70 is used to draw out the film F, there is no possibility of any substantial force acting on the gripped film F to cause it to slip out. Even when the film F is stretched in its width direction, moreover, it cannot be substantially influenced thereby and be positively urged to slip out. Therefore, the film contact members 100 and 101 of the materials mentioned later may be omitted, or polyurethane sponge rubber of the conventional closed-cell foam structure may be used instead.

In each of the side grippers 85 and 86, as shown in FIGS. 7A and 7B, moreover, the film contact member 100 with a thickness of about 1 mm, for example, is bonded covering the lower surface of the distal end portion 88*a* of each upper clamper 88, and the film contact member 101 with a thickness of about 4 mm, for example, covering the upper surface of the distal end portion 89*a* of each lower clamper 89.

Each upper clamper 88 is provided with a flange 88*c* having a shape such as to surround the whole peripheral edge of the film contact member 100 fixed thereto except its rear end, that is, the edge on the side of the projections 88*b*. The flange 88*c* is bent to have a height H (shown in FIG. 7B) that is greater than the thickness of the contact member 100. The flange 88*c* serves to reduce frictional resistance between the contact member 100 and the film F caused when the seized film F is also brought into contact with the flange 88*c* and tucked under the outer surface of the base of the tray 10. By doing this, the operations of the side grippers 85 and 86 can be facilitated in a manner such that the tucked film F is maximally checked from hindering the return of the grippers 85 and 86 to their respective original standby positions after the side edge portions F2 and F3 of the film F are tucked under the outer surface of the base of the tray 10 during the film packaging operation. A similar measure (not shown) is provided for the upper clamper 64 of the front gripper 70.

The opposite film contact members 100 and 101 can touch or leave one another as the grippers 70, 85 and 86 are closed or opened. The contact members 100 that are attached to the upper clampers 64 and 88 are formed of a material that absorbs moisture and has a property such that a frictional force between the members 100 and the film F makes no change or increases, thus maintaining a value not smaller than a given value, as the ambient humidity rises.

This material may be selected out of any suitable materials that have a fibrous structure in which innumerable fibers are intertwined in the form of a network. These available materials include, for example, leathers (natural leathers, such as animal skins, and artificial leathers, such as vinyl leather, synthetic leather, etc.), non-woven fabrics, and foams having a closed- or open-cell structure, such as polyurethane sponge rubber.

According to the first embodiment, the film contact members 100 situated on the upper surface side of the film F are formed of a tanned cowhide (or oxhide), the most suitable one of easily available animal skins for film gripping. Generally, natural leathers, not to mention cowhides, have a high rate of moisture absorption (mass of absorbed water vapor per unit area of leather) and a high water vapor permeability (weight of water vapor that passes through the unit area of a filmy substance in a fixed period of time). Accordingly, they can control water in the air, and tend to increase in surface area and become softer when they absorb water.

Figure 10:
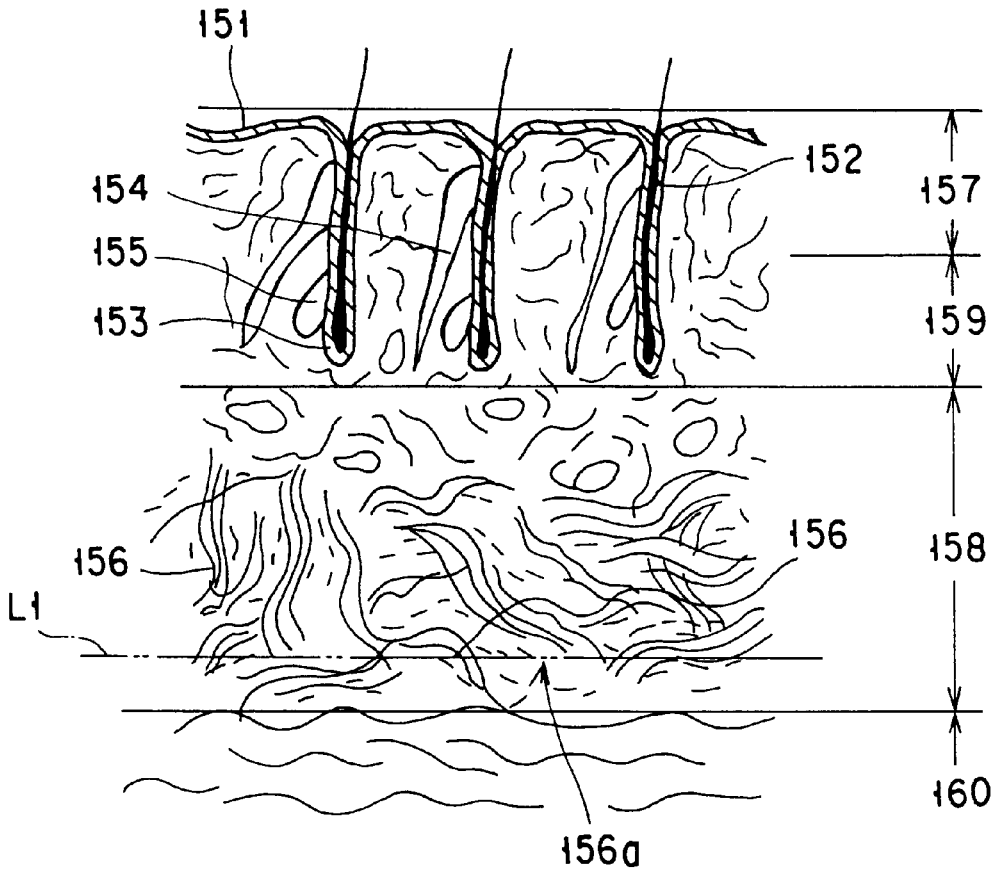
FIG. 10 is a sectional view showing an arrangement of a film contact member of leather used in the packaging machine.

FIG. 10 shows a leather texture. In FIG. 10, numerals 151, 152, 153, 154 and 155 denote the epidermis or the outermost layer of the skin, hair shafts, hair roots, pilomotor muscles, and sweat glands, respectively. Further, numerals 156, 157, 158, 159 and 160 denote fibers, grain layer, reticular layer, border layer between the layers 157 and 158, and flesh-side layer, respectively.

Each fiber 156 has a spiral structure in which various amino acids are coupled in a chain. Hundreds of such fibers are joined to form a fascicle. Such fascicles are further joined and finally intertwined with one another. Thus, the reticular layer 158 has a fibrous structure in which innumerable fibers 156 are intertwined in the form of a network. Since the fibers in the reticular layer 158 are thick and dense, they are somewhat stiff but strong. In contrast with this, the fibers in the grain layer 157 lack in strength, although they are fine and soft. The fibers of a cowhide are particularly thick and dense and are intertwined well enough to ensure a fibrous structure of good quality.

In the cowhide having the fibrous structure described above, the flesh-side layer 160 is trimmed off along a two-dot chain line L1 that passes through the reticular layer 158, as shown in FIG. 10. In this state, the hide is utilized for the film contact members 100. The resulting fibrous structure is bonded to each of the upper clampers 64 and 88 in a manner such that its trimmed surface 156*a* is exposed.

In use, the exposed surface 156*a* of this structure is brought into contact with the film F.

The film contact members 101 that are bonded to the lower clampers 68 and 89 may be formed of the same material as that of the film contact members 100 or a foam such as polyurethane sponge rubber having an open- or closed-cell structure. In this first embodiment, the lower film contact members 101 that are situated on the package-surface side of the film F are formed of polyurethane sponge rubber, an aggregate of closed cells. This sponge rubber is excellent in impact resilience, wear resistance, tear resistance, etc. Polyurethane sponge rubber of the open-cell structure has substantially the same properties.

Thus, the lower film contact members 101 attached to the lower clampers 68 and 89, which are moved downward to be opened, are formed of polyurethane sponge rubber. Even if the contact member 101 is soiled by gravy, juice or the like that oozes out of foodstuff or some other product packaged together with the tray 10, therefore, the resulting stains or the like can be more easily removed by cleaning than in the case of the cowhide contact members 100 on the upper side. The reasons for this are associated with both the position and material. For reasons to the contrary, it is possible to reduce the gravy or the like from the foodstuff that soils the hide, the material of the upper film contact members 100 attached to the upper clampers 64 and 88. In consequence, the respective predetermined gripping forces of the film contact members 100 and 101 can be maintained for a long period of time.

In addition, polyurethane sponge rubber is softer than the leather used for the film contact members 100. Thus, if the second film contact members 101 that are softer and thicker are used in combination of the first film contact members 100 that are made of leather (without regard to their relative positions in the vertical direction), the side grippers 85 and 86 can hold the edge portions of the film F more fittingly and securely.

Figure 11:
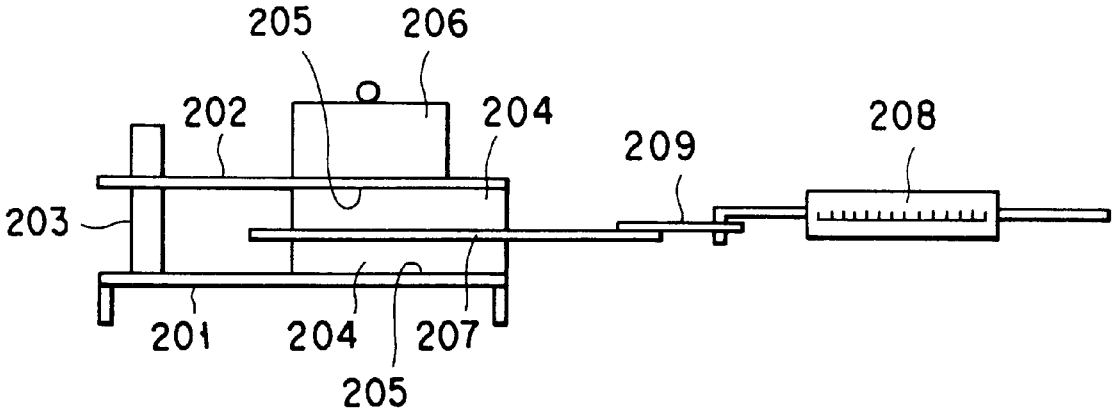
FIG. 11 is a side view showing an arrangement a tester for a frictional force measurement test.
Figure 12:
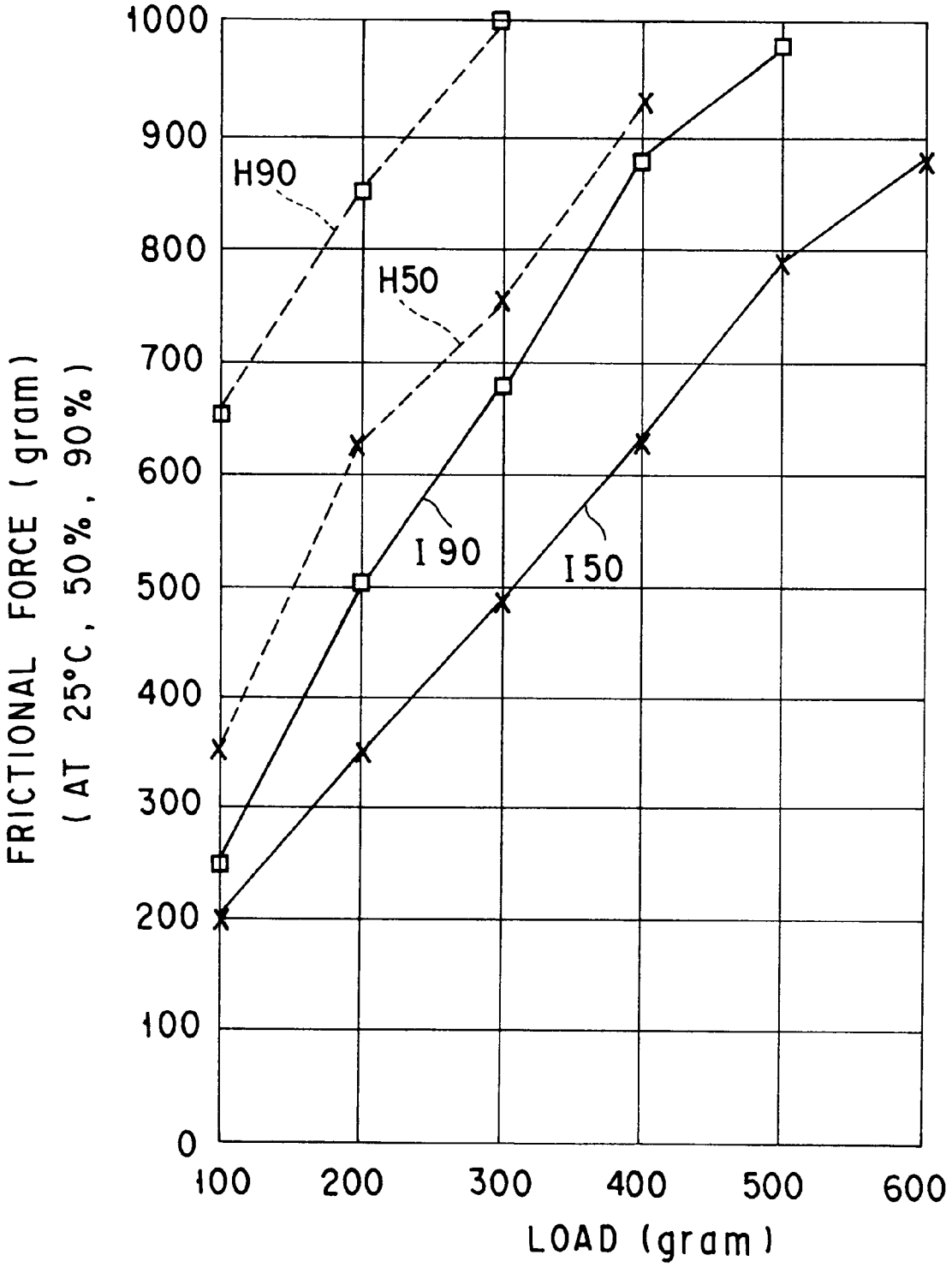
FIG. 12 is a diagram showing the relationship between load and frictional force.
Figure 13:
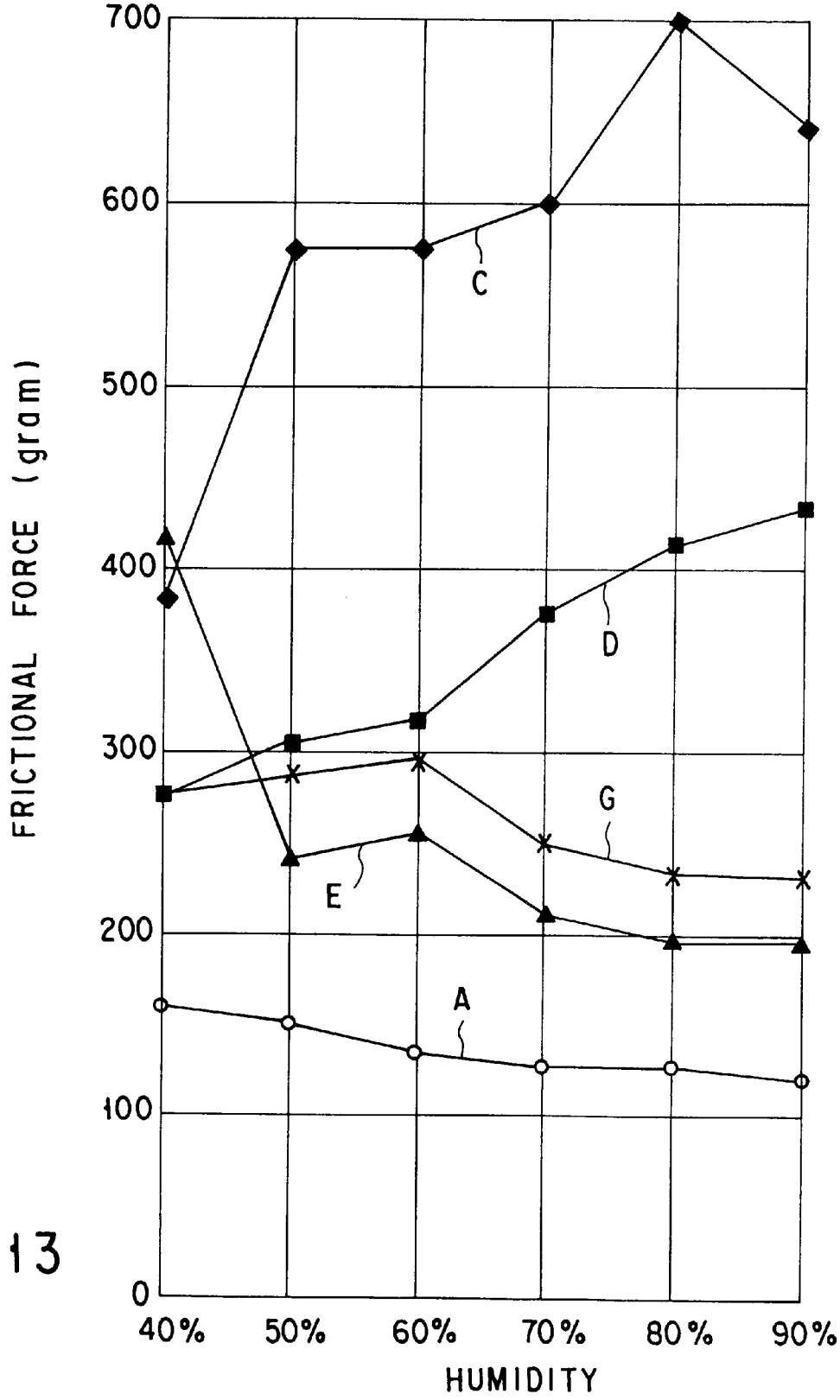
FIG. 13 is a diagram showing the relationship between humidity and frictional force.

FIG. 13 shows results of frictional force measurement on the materials of the film contact members 100 and 101 using a frictional force measuring tester shown in FIG. 11. FIG. 12 shows results of frictional force measurement obtained with use of varied weight loads (grams) on the tester.

The test results shown in FIG. 13 are obtained in the same manner as the one described concerning the prior art. In this case, the test was conducted at the temperature of 25° C. In Sample C, the tanned cowhide is used for both the film contact members 100 and 101. In Sample D, the tanned cowhide is used for the one film contact member 100, while closed-cell polyurethane sponge rubber is used for the other film contact member 101 as described in the first embodiment. In Sample E, both contact members 100 and 101 are formed of a rubber sheet material for belt rollers. In Sample G, the contact members 100 and 101 are formed of the silicone rubber. FIG. 13 also shows the result for the prior art case A for comparison.

Also in the test method for the results shown in FIG. 12, values of the frictional force were measured with the weight load increased by 100 grams at the temperature of 25° C. and at the humidity of 50% and 90%. Samples used in this test include Samples H50 and H90 in which both film contact members 100 and 101 are formed of the tanned cowhide and Samples I50 and I90 in which the film contact members 100 and 101 are formed of the tanned cowhide and closed-cell polyurethane sponge rubber, respectively, as in the case of the first embodiment. Curves H50 and I50 represent results obtained at the humidity of 50%, and curves H90 and I90 at 90%.

In any of the cases of these samples, as seen from FIG. 12, the frictional force increases substantially in proportion to the weight load. This holds true without regard to the humidity. In other words, the film gripping force was found to increase with the load despite the rise of the humidity. It was indicated, moreover, that homogeneous pairs of film contact members, both formed of the tanned cowhide, have a greater initial film gripping force than heterogeneous ones, formed individually of the cowhide and polyurethane sponge rubber. This tendency is maintained although the humidity is increased.

As seen from FIG. 13, Sample C, a combination of the film contact members both formed of the cowhide, X has a great initial gripping force. As the humidity rises, moreover, the frictional force of Sample C drastically increases and then stays within the range of the increase. Thus, Sample C, among the other ones, was found to be able to maintain the greatest frictional force, though it exhibited a minor reduction in the frictional force within the range of the aforesaid increase when the humidity was at 90%. It was revealed, furthermore, that the frictional force of Sample D according to the first embodiment continues to increase gradually with the increase of the humidity, though the initial frictional force of this sample proved to be a little smaller than that of Sample C.

Thus, Samples C and D can enjoy empirically appropriate frictional forces for normal packaging operation at normal and high humidities, and maintain at high humidity a frictional force equal to or greater than at normal humidity.

These results are attributable to the fact that at least one of the film contact members used in Samples C and D is formed of the cowhide, a water-absorbing material that has a fibrous structure in which innumerable fibers are intertwined in the form of a network, as mentioned before, and whose surface is adapted to touch the film F. Although the cause of this effect has not yet been cleared up exactly, it may possibly involve the following reasons.

With use of this material, water entrapped between the film F and the film contact surface is believed to be quickly absorbed by a capillary action in the network. Further, the ends of the innumerable fibers in the network are exposed in each of the respective film contact surfaces of Samples C and D. If a water film is formed between the film F and the film contact surface, therefore, the fiber ends are expected immediately to break it and directly touch the film F. These phenomena are supposed to occur independently or concurrently.

Since these phenomena prevent water from staying on the film contact surface of the fibrous structure in the form of the network containing the innumerable entangled fibers, the frictional force (gripping force) between the contact surface and the film F cannot be reduced if the ambient humidity increases. Owing to the aforesaid capillary phenomenon, moreover, the network maintains some moisture, increases its area, and becomes softer. The higher the ambient humidity, therefore, the more intimately the film contact surface can touch the film F. Thus, the frictional force between the contact surface and the film F is believed to increase in proportion to the humidity.

The measurement results for Samples C and D shown in FIG. 13 are supposed to be obtained in this manner. The combination of the materials for Sample D can ensure a higher frictional force than the following combination for Sample E. Presumably, this is because the frictional force at high humidity is supplemented by the properties of the leather material for the one film contact member of Sample D, whereas the combination for Sample E undergoes some reduction in the frictional force at high humidity.

In the case of Sample E, the frictional force is suddenly reduced as the humidity increases, although the initial frictional force is relatively great. It was found in this case, however, that an appropriate frictional force for normal packaging operation can barely be maintained at normal or high humidity.

In the case of Sample E, the increase of the humidity is believed to result in the reduction of the frictional force because the film contact surface is relatively smooth and somewhat reluctant to be permeated by water, so that a water film between the contact surface and the film cannot be broken with ease. Although the frictional force is reduced as the humidity increases from the normal level, in this case, the minimum frictional force obtained at high humidity can be not lower than the maximum frictional force (about 160 grams at 40% humidity) of the conventional Sample A shown in FIG. 13. Also in the case where the film contact member is formed with use of Sample E, therefore, the appropriate frictional force for normal packaging operation can barely be maintained at normal or high humidity.

Although the initial frictional force of Sample G as a control for comparison is a little smaller that of Sample C, moreover, it was found that the frictional force slightly increases and then gradually decreases as the humidity increases. Nevertheless, the empirically appropriate frictional forces for normal packaging operation can barely be maintained at normal or high humidity. As mentioned before, however, this sample leaves room for improvement in durability, since its film-releasability lowers after prolonged use.

Hides such as tanned cowhides, unlike silicone sponge rubber, contain no plasticizers that are based on siloxane or other low-molecular materials. Therefore, there is no possibility of the film contact surface changing its properties and becoming sticky as it is used. Since the innumerable fiber ends are exposed in the film contact surface, moreover, the contact surface rarely becomes as smooth as a mirror surface although it wears during use. Consequently, the film-releasability is satisfactory. It has already been ascertained that polyurethane sponge rubber used in combination with leather is excellent in durability and film-releasability.

Thus, Samples C, D and E enjoy satisfactory film-releasability. According to results of a horizontal separating force tests (50,000 test cycles at 25° C. and 50%), it was recognized that Samples C to E have a horizontal separating force of 100 grams or less on the average.

In the horizontal separating force test, a measuring film is pressed against one of upper and lower film contact members that are attached individually to a pair of openable clamping portions, while paper is interposed between the film and the surface of the other film contact member lest the other contact member influence the test. The film is gripped for about 30 seconds in this state, and thereafter, the clamping portions are slowly opened to release the measuring film. Then, the measuring film is pulled parallel to the film contact surface of the aforesaid one film contact member in contact with the film by means of a tension gage. The force (horizontal separating force) with which the film is separated from the contact surface is measured.

Thus, the film packaging machine 1 according to the first embodiment is provided with the grippers 70, 85 and 86 based on the combinations of the film contact members 100 and 101, and serves automatically to package the tray 10 in the manner described above. According to this packaging machine 1 and the film packaging method carried out thereby, the film gripping force is never reduced despite the increase of the humidity, and the film-releasability is satisfactory. It is confirmed that a frictional force similar to the one represented by curve D in FIG. 13 can be obtained with use of a combination (not shown) of an upper film contact member 100 of a cowhide and a lower film contact member of the aforesaid closed-cell polyurethane. Also in this case, the film gripping force is never reduced despite the increase of the humidity, and the film-releasability is satisfactory.

If the film F is drawn out or stretched by means of the film gripper that is composed of the film contact members 100 and 101 combined in this manner, the film can be prevented from slipping off the grippers 70, 85 and 86. When the side grippers 85 and 86 are opened and return to their respective original positions after the film F is tucked under the outer surface of the base of the tray 10, moreover, the grippers 85 and 86 can be prevented from being ill balanced as they release the film F or from dragging the film. Accordingly, lap portions of the film F on e the underside of the tray 10 can be long enough, the film cannot be torn, and the tray 10 can be prevented from being dragged together with the film F. Thus, the automatic packaging operation can be accomplished without failure or defectiveness.

The present invention is not limited to the first embodiment described above. According to the first embodiment, for example, a plurality of film nipping portions are unitized, each combining a pair of openable side grippers 85 and 86. Alternatively, however, the gripper portions 85*a* to 85*g* and 86*a* to 86*g*, each including the openable film nipping portions, may be regarded individually as film grippers according to the invention. The film contact members may be bonded to the film nipping portions by means of an adhesive agent or double-side-coated adhesive.

Further, each pair of film nipping portions may be designed for open-close operation in a manner such that the upper and lower ones are rotatable and unrotatable, respectively, or both rotatable.

It is to be understood that the respective film contact surfaces of the film contact members of the gripper portions that are adapted to touch the film vary in size depending on the film gripping structure. In the case where one film gripper is located on one side of the film in the width direction thereof, for example, its size should be adjusted to the length of the longest side of the object to be packaged. Further, each film contact member may be partially recessed so that only its peripheral portion or some other part can be in contact with the film. In the case where each side gripper, like the side grippers 85 and 86 according to the first embodiment, includes a plurality of pairs of film nipping portions, only some of the nipping portions may be provided with the film contact members. Likewise, a long gripper such as the front gripper 70 may be partially provided with the film contact members that are arranged intermittently, for example, along its longitudinal direction.

Further, the present invention may be also applied to a batching-packaging-labeling machine, which has a batcher attached to its tray loading section. This machine serves not only to package a to-be-packaged object in a film, but also to issue a price tag or label (printed with a price fixed according to the batching by means of the batcher) through its tray unloading section and stick it on a packaged tray.

Furthermore, the film gripper according to the present invention may be used in a manner such that it is manually moved to package a to-be-packaged object in a film. More specifically, film contact members similar to the aforesaid ones may be attached to some tools like gloves so that the object can be packaged in the film stretched by an operator's hands in the gloves.

Additional advantages and modifications will readily occurs to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A film gripper for holding a film for wrapping a to-be-packaged object therein, comprising:

first and second film nipping portions combined so as to be movable with respect to each other for open-close operation, and adapted to be driven toward each other in a closing direction when the film is to be held and to be driven away from each other in an opening direction after the to-be-packaged object is packaged in the film; and a film contact member provided on at least one of the first and second film nipping portions, and adapted to touch the film when the first and second film nipping portions are closed, wherein the film contact member is formed of a material which is a fibrous aggregate in a network form containing a large number of fibers intertwined with one another, and a part of the fibrous aggregate is exposed in a surface of the film contact member so as to be in contact with the film, said material having a property such that a frictional force between the film contact member and the film remains stable or increases as humidity around the film rises and such that film-releasability is maintained.

2. A film gripper according to claim 1, wherein said material is a leather.

3. A film gripper according to claim 2, wherein said leather is animal skin.

4. A film gripper according to claim 2, wherein said leather comprises animal skin having a reticular layer containing a large number of fibers, and a part of the reticular layer exposed by cutting in a direction parallel to an outermost layer of the skin comprises a contact surface for contacting the film.

5. A film packaging machine provided with a film gripper for holding an edge portion of a film for wrapping a to-be-packaged object therein, the film gripper comprising:

first and second film nipping portions combined so as to be movable with respect to each other for open-close operation, and adapted to be driven toward each other in a closing direction when the film is to be held and to be driven away from each other in an opening direction after then moving along an underside of the to-be-packaged object so that the film is put on the underside of the to-be-packaged object to package the object therein; and a film contact member attached to at least one of the first and second film nipping portions, and adapted to touch the film when the first and second film nipping portions are closed, wherein the film contact member is formed of a material which is a fibrous aggregate in a network form containing a large number of fibers intertwined with one another, and a part of the fibrous aggregate is exposed in a surface of the film contact member so as to be in contact with the film, said material having a property such that a frictional force between the film contact member and the film remains stable or increases as humidity around the film rises and such that film-releasability is maintained.

6. A film packaging machine according to claim 5, wherein said film gripper includes drive means for stretching the film by moving the film nipping portions with an edge portion of the film held thereby.

7. A film packaging machine according to claim 6, wherein said drive means of the film gripper stretches the film to 150% to 300%.

8. A film packaging machine according to claim 6, further comprising means for holding a reel wound with the film, and wherein said drive means of the film gripper stretches the film in a direction perpendicular to a direction of delivery of the film from the reel.

9. A film packaging machine according to claim 6, further comprising a lifter for pushing up the to-be-packaged object from under the film, whereby the to-be-packaged object is raised relatively to the film so as to be covered therewith.

10. A film packaging machine according to claim 5, further comprising a loading section for loading the to-be-packaged object, a packaging section including the film gripper, and an unloading section for unloading the packaged object, the loading section having a path of transfer for the object extending at right angles to that of the unloading section.

11. A film packaging machine according to claim 10, further comprising heating means near the packaging section for welding the film to the to-be-packaged object.

12. A film packaging machine according to claim 6, wherein the force of said film gripper to nip the edge portion of the film is 160 grams or more, and the force of said film gripper to separate from the edge portion of the film is 100 grams or less.

13. A film gripper for holding a film for wrapping a to-be-packaged object therein, comprising:

first and second film nipping portions combined so as to be movable with respect to each other for open-close operation, and adapted to be driven toward each other in a closing direction when the film is to be held and to be driven away from each other in an opening direction after the to-be-packaged object is packaged in the film;

a first film contact member provided on the first film nipping portions, and adapted to touch the film when the first and second film nipping portions are closed, wherein the first film contact member is formed of a material which is a fibrous aggregate in a network form containing a large number of fibers intertwined with one another, and a part of the fibrous aggregate is exposed in a surface of the film contact member so as to be contact with the film, said material having a property such that a frictional force between the film contact member and the film makes remains stable or increases as humidity around the film rises and such that film-releasability is maintained; and a second film contact member provided on the second film nipping portion, wherein the second film contact member is formed of the same material as the first film contact member or a material selected from a group including leather, foam, and non-woven fabric.

14. A film gripper according to claim 13, wherein said first film contact member attached to the first film nipping portion is formed of cowhide, and said second film contact member attached to the second film nipping portion is formed of polyurethane sponge rubber.

15. A film gripper according to claim 14, wherein said second film contact member of polyurethane sponge rubber is attached to the second film nipping portion situated on a lower surface side of the film.

* * * * *